US008002270B2

(12) United States Patent
Blair et al.

(10) Patent No.: US 8,002,270 B2
(45) Date of Patent: Aug. 23, 2011

(54) MEDIA TRAY WITH MEDIA RESTRAINT ASSEMBLY ADJUSTABLE BETWEEN AND LOCKABLE AT MULTIPLE CLOSELY SPACED POSITIONS

(75) Inventors: Brian Allen Blair, Richmond, KY (US); Jason Lee Rowe, Richmond, KY (US); Edward Lynn Triplett, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 357 days.

(21) Appl. No.: 12/128,683

(22) Filed: May 29, 2008

(65) Prior Publication Data

US 2009/0295072 A1 Dec. 3, 2009

(51) Int. Cl.
*B65H 1/00* (2006.01)

(52) U.S. Cl. ..... 271/171

(58) Field of Classification Search ..... 271/171, 271/145

See application file for complete search history.

(56) References Cited

U.S. PATENT DOCUMENTS

| | | | | |
|---|---|---|---|---|
| 5,029,841 | A * | 7/1991 | Ettischer et al. | 271/171 |
| 7,607,657 | B2 * | 10/2009 | Kawarago | 271/171 |
| 7,712,988 | B2 * | 5/2010 | Hattori | 400/624 |
| 2006/0113723 | A1 * | 6/2006 | Ito et al. | 271/162 |
| 2007/0147940 | A1 * | 6/2007 | Hattori | 400/624 |
| 2008/0079214 | A1 * | 4/2008 | Kawarago | 271/18 |

* cited by examiner

*Primary Examiner* — Stefanos Karmis
*Assistant Examiner* — Thomas A Morrison

(57) ABSTRACT

A media tray includes a housing and a media restraint assembly mounted in the housing having a position selection mechanism for placing respective floor portions of the housing in a selected one position of a multiplicity of closely spaced apart positions. The position selection mechanism includes an actuator adapted for undergoing movement relative to the floor portions along a first direction between extended and retracted positions and a position securement arrangement adapted for undergoing conversion along a second direction transverse to the first direction between engaged and disengaged conditions in response to movement of the actuator between the extended and retracted positions to correspondingly select and de-select the selected one position of the floor portions and accordingly set the floor portions at and release the floor portions from the selected one position thereof. The media restraint assembly also includes an actuation lever and a lock mechanism for the lever.

19 Claims, 5 Drawing Sheets

MEDIA TRAY WITH MEDIA RESTRAINT ASSEMBLY ADJUSTABLE BETWEEN AND LOCKABLE AT MULTIPLE CLOSELY SPACED POSITIONS

BACKGROUND

1. Field of the Invention

The present invention relates generally to media trays for image forming machines and, more particularly, to a media tray with a media restraint assembly that is adjustable between and lockable at multiple closely spaced positions.

2. Description of the Related Art

Media trays in some image forming machines, such as laser printers, have media restraint assemblies adjustable to different discrete preset positions for adapting them to accommodate stacks of media of a limited number of different standard sheet lengths, such as letter, legal, exec, A4, A5 and B5. These media restraint assemblies are frequently designed to allow users themselves to make the adjustment of the media restraint assemblies for changing the media setup from one size to another.

One problem associated with such media restraint assemblies is their inability to be robust enough against aggressive and abusive user handling situations. This can include, but is not limited to, rough insertion and removal of the media tray. A problem known from experience with many laser printers is that if a media tray is installed very aggressively, the media restraint assembly can move out of its set position under the load of the media in the media tray. This can lead to media jams, other mis-feed issues, and user frustration.

In addition, many purchasers are beginning to request that some kind of user settable locking function be added to media restraint assemblies. By doing so, network administrators can then set the media tray of the image forming machine to a desired media size for their network and not have to worry about the position being moved over time, either under abusive conditions or by other users themselves.

Thus, there is a need for an innovation that will address these problems.

SUMMARY OF THE INVENTION

The present invention meets this need by providing an innovation that introduces into a media tray a media restraint assembly that is adjustable between and lockable at multiple closely spaced positions with a construction that makes it more robust, enabling it to withstand abusive handling and use by users.

Accordingly, in an aspect of the present invention, a media tray includes a housing having first and second housing parts interfitted with one another and slidably movable toward and away from one another along a first direction to form respective floor portions of the housing parts into a floor of the housing adapted to support a stack of sheets of media thereon of different sheet lengths, and a media restraint assembly including a position selection mechanism for placing respective floor portions of the housing parts in a selected one position with respect to one another of a multiplicity of closely spaced apart positions corresponding to different sheet lengths. The position selection mechanism has an actuator mounted on the floor portion of the first housing part for undergoing movement relative thereto along the first direction between extended and retracted positions, and a position securement arrangement mounted on the floor portions of the first and second housing parts for undergoing conversion along a second direction transverse to the first direction between engaged and disengaged positions in response to movement of the actuator along the first direction between the extended and retracted positions to correspondingly select and de-select the selected one position of the floor portions and accordingly set the floor portions at and release the floor portions from the selected one position.

In another aspect of the present invention, a media restraint assembly includes a position selection mechanism for placing respective floor portions of a housing of a media tray in a selected one position with respect to one another of a multiplicity of closely spaced apart positions corresponding to different sheet lengths of media stacked at the selected one position wherein the position selection mechanism includes an actuator adapted for undergoing movement relative to the floor portions along a first direction between extended and retracted positions, a position securement arrangement adapted for undergoing conversion along a second direction transverse to the first direction between engaged and disengaged conditions in response to movement of the actuator along the first direction between the extended and retracted positions to correspondingly select and de-select the selected one position of the floor portions and accordingly set the floor portions at and release the floor portions from the selected one position, and an actuation lever for undergoing movement between de-actuated and actuated positions wherein the actuator is moved to the extended position in response to the actuation lever being moved to the de-actuated position and the actuator is moved to the retracted position in response to the actuation lever being moved to the actuated position.

In a further aspect of the present invention, a media restraint assembly includes a position selection mechanism for placing respective floor portions of a housing of a media tray in a selected one position with respect to one another of a multiplicity of closely spaced apart positions corresponding to different sheet lengths of media stacked at the selected one position wherein the position selection mechanism includes an actuator adapted for undergoing movement relative to the floor portions along a first direction between extended and retracted positions and a position securement arrangement adapted for undergoing conversion along a second direction transverse to the first direction between engaged and disengaged conditions in response to movement of the actuator along the first direction between the extended and retracted positions to correspondingly select and de-select the selected one position of the floor portions and accordingly set the floor portions at and release the floor portions from the selected one position, a plurality of detents representing a corresponding plurality of standard length settings of sheets of media, and a tactile feedback mechanism alignable with each of the detents for providing a user with a tactile and audible feedback when one of the detents is encountered by the tactile feedback mechanism.

BRIEF DESCRIPTION OF THE DRAWINGS

Figure 1:
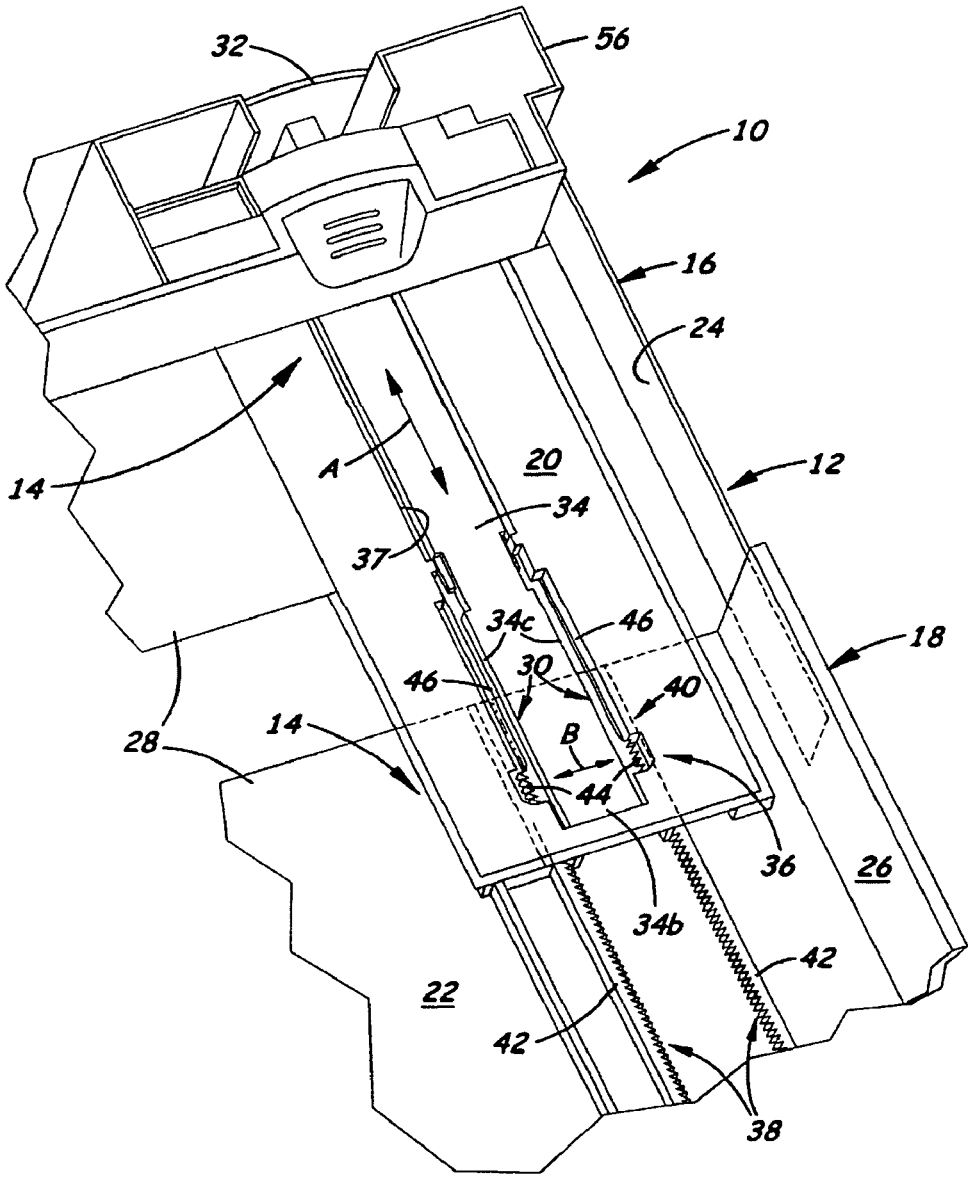

Having thus described the invention in general terms, reference will now be made to the accompanying drawings, which are not necessarily drawn to scale, and wherein:

FIG. 1 is a top perspective fragmentary view of a media tray having a multi-position adjustable and lockable media restraint assembly according to the present invention.

Figure 2:
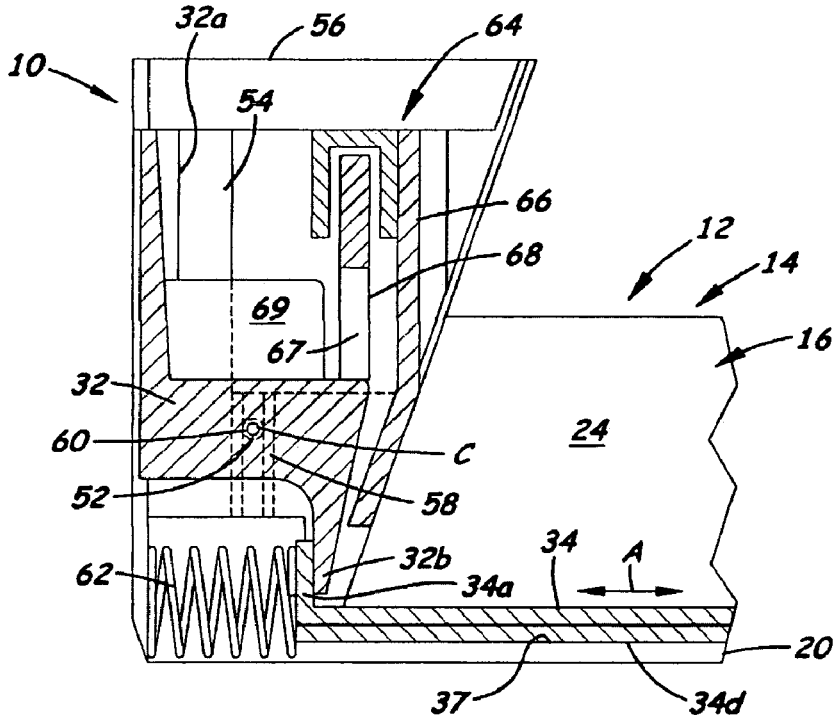

FIG. 2 is an enlarged foreshortened side elevational view, with portions sectioned, of the media restraint assembly as seen along line 2—2 of FIG. 1, showing an actuation lever of the assembly in a de-actuated position.

Figure 3A:
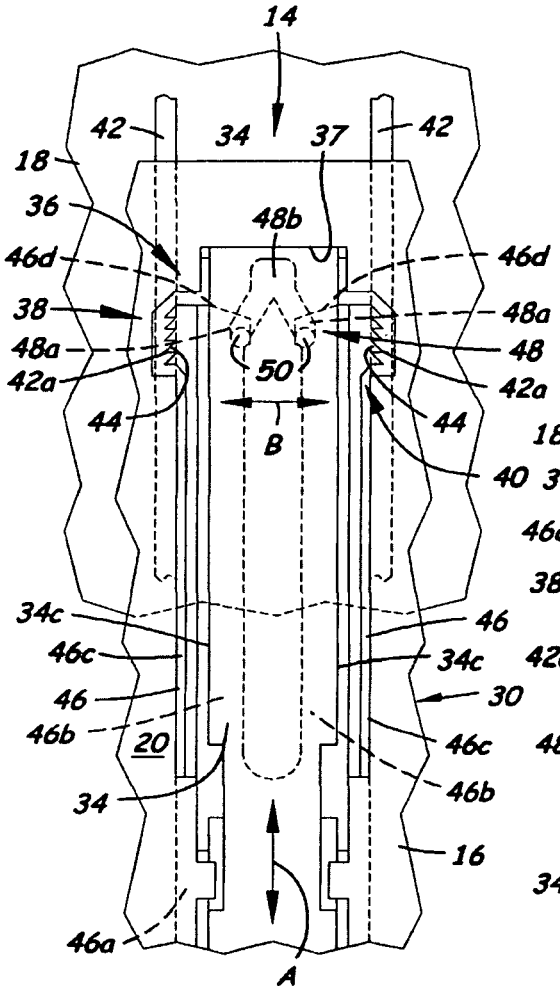

FIG. 3A is an enlarged fragmentary top plan view of a position selection mechanism of the media restraint assembly of FIG. 1, showing an actuator of the mechanism in an extended position and a position securement arrangement of the mechanism in an engaged condition.

Figure 3B:
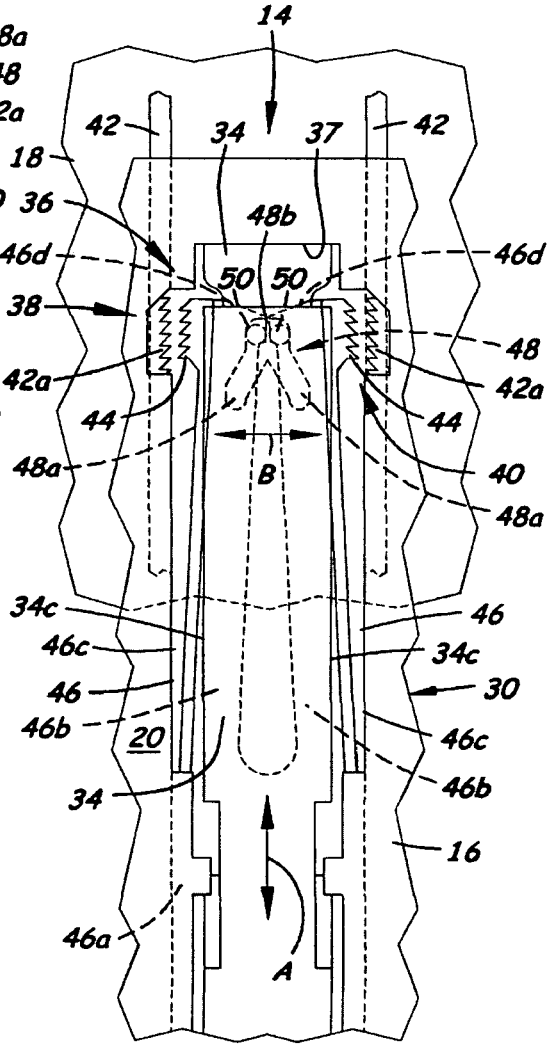

FIG. 3B is a view similar to that of FIG. 3A, except now showing the actuator of the mechanism in a retracted position and the position securement arrangement of the mechanism in a disengaged condition.

Figure 4A:
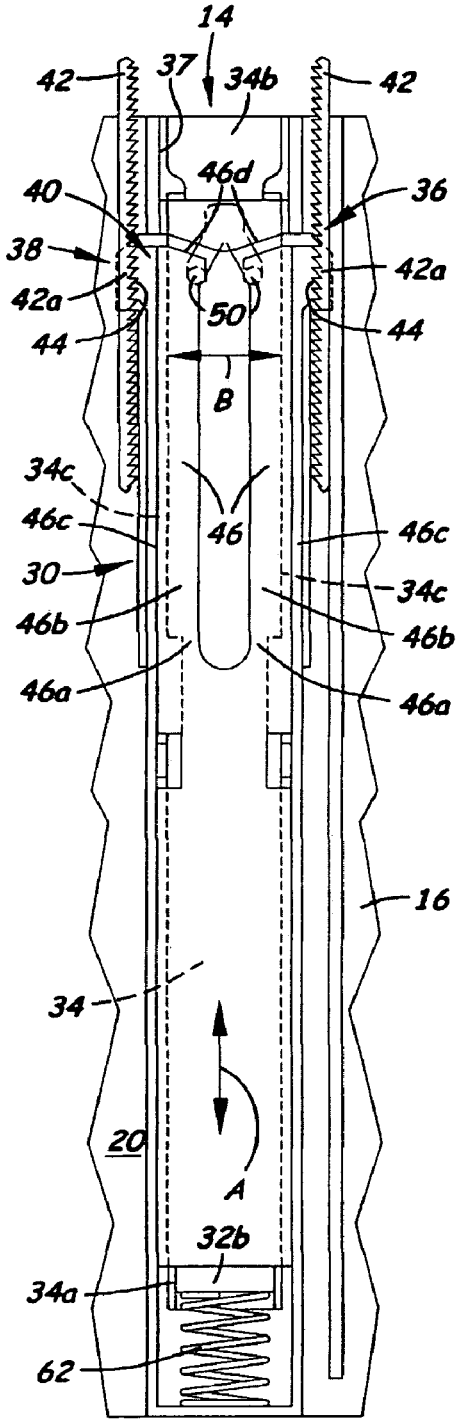

FIG. 4A is an enlarged fragmentary bottom view of the position selection mechanism of FIG. 1, showing the actuator of the mechanism in the extended position and the position securement arrangement of the mechanism in the engaged condition.

Figure 4B:
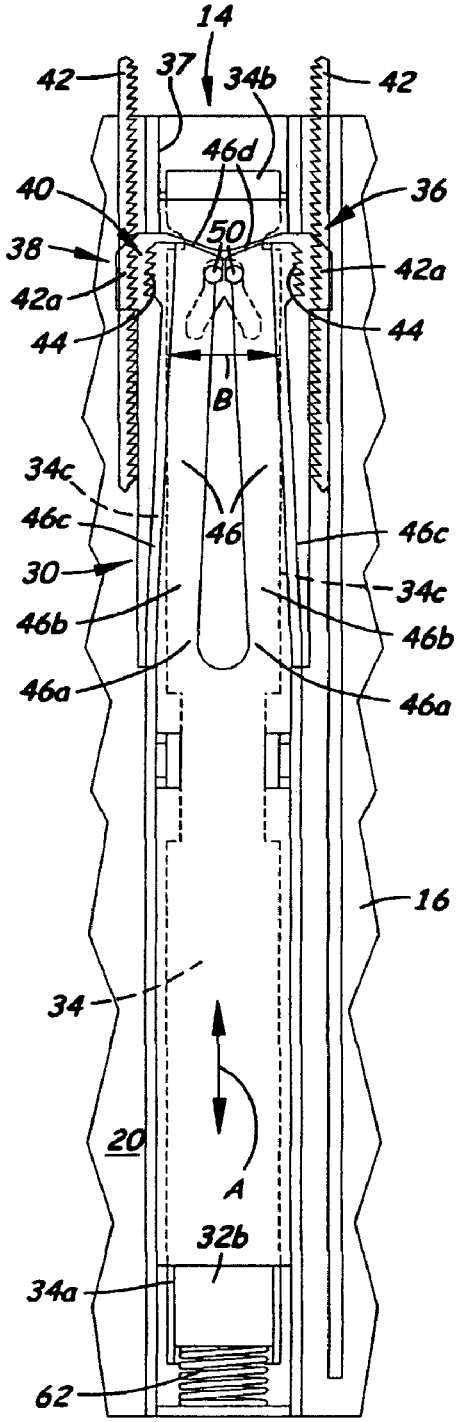

FIG. 4B is a view similar to that of FIG. 4A, except now showing the actuator of the mechanism in the retracted position and the position securement arrangement of the mechanism in the disengaged position.

Figure 5:
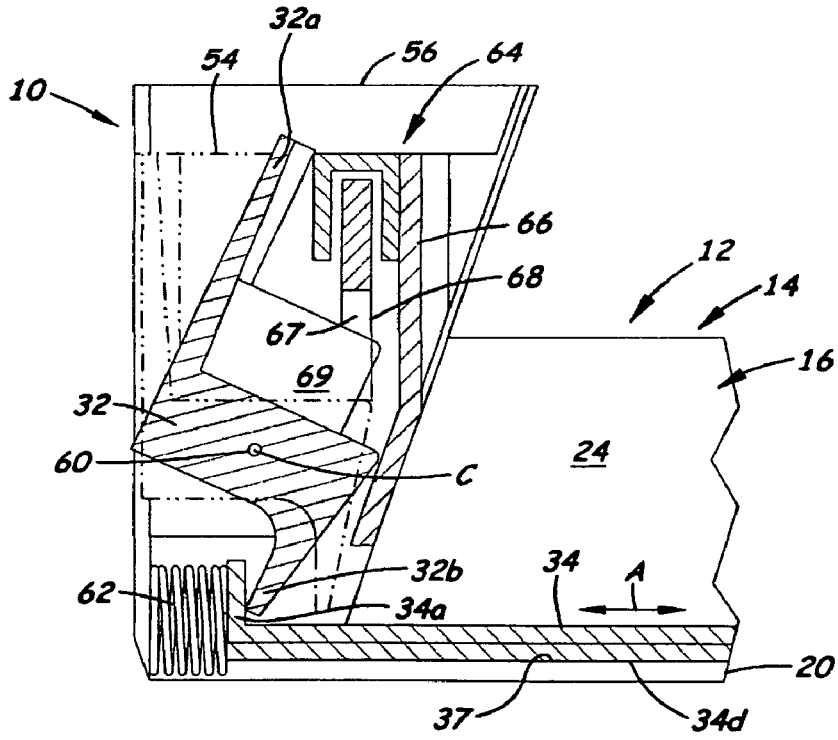

FIG. 5 is a view similar to that of FIG. 2, except now showing the actuation lever in an actuated position.

Figure 6A:
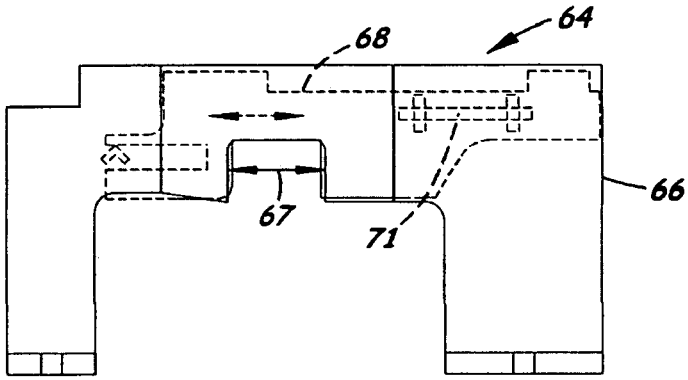

FIG. 6A is a sectional view as seen along 6A-6A of FIG. 2, showing a lock mechanism of the assembly in a locked position.

Figure 6B:
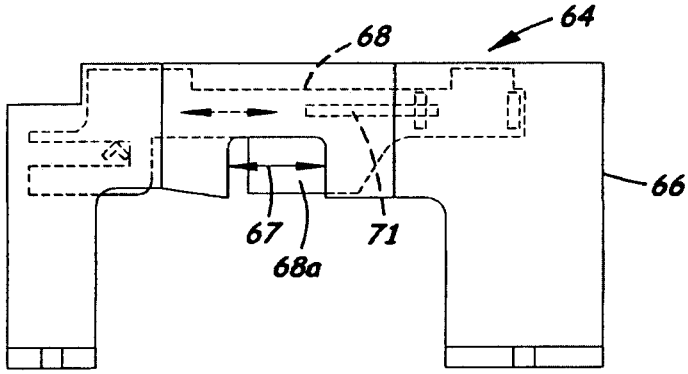

FIG. 6B is a view similar to that of FIG. 6A, except now showing the lock mechanism in an unlocked position.

Figure 7:
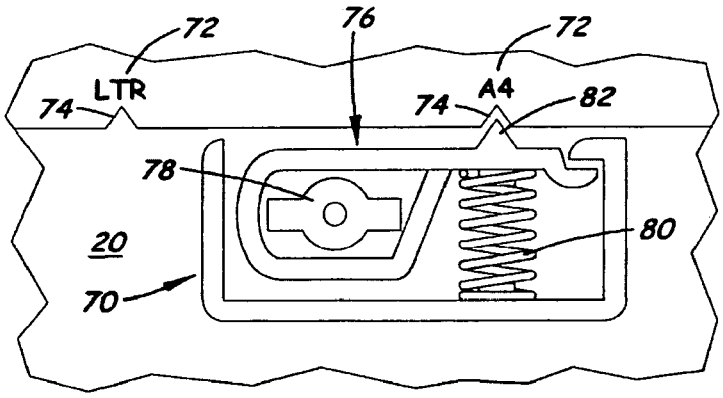

FIG. 7 is an enlarged fragmentary top plan view of a tactile feedback mechanism of the assembly, with portions of the housing bottom broken away, of indicia on the housing bottom of the standard lengths of sheets of media, showing the mechanism in an engaged position with a detent indicating one of the standard lengths of sheets of media.

DETAILED DESCRIPTION

The present invention now will be described more fully hereinafter with reference to the accompanying drawings, in which some, but not all embodiments of the invention are shown. Indeed, the invention may be embodied in many different forms and should not be construed as limited to the embodiments set forth herein; rather, these embodiments are provided so that this disclosure will satisfy applicable legal requirements. Like numerals refer to like elements throughout the views.

Referring now to FIGS. 1 and 2, there is illustrated a media tray, generally designated 10, which includes a housing 12 and an exemplary embodiment of a media restraint assembly, generally designated 14, of the present invention installed thereon. The housing 12 has first and second housing parts 16, 18 with respective first and second floor portions 20, 22 and sidewall portions 24 (only one sidewall being shown) thereon. The housing parts 16, 18 at their sidewall portions 24, 26 are designed to interfit with one another in a known manner such that the housing parts 16, 18 are slidably movable toward and away from one another along a first direction, indicated by double-headed arrow A, to form the respective first and second floor portions 20, 22 of the first and second housing parts 16, 18 into a floor 28 of the housing 12 whose load support area can be changed by operation of the media restraint assembly 14 so as to adapt it to support a stack (not shown) of sheets of media of various different lengths.

Referring now to FIGS. 1-5, there is illustrated the exemplary embodiment of the media restraint assembly 14. The media restraint assembly 14 includes a position selection mechanism, generally designated 30, for placing the respective floor portions 20, 22 of the first and second housing parts 16, 18 in a selected one position with respect to one another of a potential multiplicity of closely spaced apart positions corresponding to different sheet lengths in a stack of media. The assembly 14 also includes an actuation lever 32 which is employed by a user to actuate the operation of the position selection mechanism 30 to change the selected one position of the housing parts 16, 18 relative to one another. The actuation lever 32 will be described in greater detail later on.

Turning first to the position selection mechanism 30, it includes an actuator 34 and a position securement arrangement 36. The actuator 34 may take the form of an elongated flat narrow blade-like member having a pair of opposite first and second ends 34*a*, 34*b*. The actuator 34 is mounted in a recessed channel 37 formed with a similar shape in the floor portion 20 of the first housing part 16. The actuator 34 needs only to undergo sliding movement for a short distance within the channel 37, along the first direction A between an extended portion, as shown in FIGS. 3A and 4A, and a retracted position, as shown in FIGS. 3B and 4B in order to perform its function which is to cause converting of the position securement arrangement 36 between its two conditions.

The position securement arrangement 36 is mounted on the floor portions 20, 22 of both housing parts 16, 18 for undergoing conversion along a second direction, as indicated by a double-headed arrow B, extending transverse to the first direction A, between an engaged condition, as shown in FIGS. 3A and 4A, and a disengaged condition, as shown in FIGS. 3B and 4B, in response to movement of the actuator 34 along the first direction A between its extended and retracted positions. In such manner, the actuator 34 and position securement arrangement 36, under the control and manipulation of the actuation lever 32 by a user, as will be explained in detail later on, cooperate to correspondingly select and de-select the selected one position of the first and second floor portions 20, 22 and accordingly set the floor portions 20, 22 at, and release the floor portions 20, 22 from, the selected one position.

Referring to FIGS. 3A-3B and 4A-4B, the position securement arrangement 36 generally includes a first set of interengageable elements, generally designated 38, immovably mounted on the floor portion 22 of the second housing part 18 and a second set of interengageable elements, generally designated 40, mounted on the floor portion 20 of the first housing part 16. The second set of interengageable elements 40 is adapted for undergoing movement along the second direction B between the engaged condition, as shown in FIGS. 3A and 4A, in response to release by the actuator 34 and the disengaged condition, as shown in FIGS. 3B and 4B, in response to contact with the actuator 34 as the actuator 34 moves between the extended and retracted positions, as correspondingly shown in the same figures. The first set of interengageable elements 38 has the form of at least one rack of a multiplicity of teeth 42, such as gear teeth. The rack of teeth 42 may be substantially linear in configuration. The second set of interengageable elements 40 has the form of at least one set of a plurality of teeth 44, such as gear teeth, for engaging with a portion 42A of the one rack of teeth 42, the portion 42A being only a short section of the teeth rack 42.

More advantageously, the first set of interengageable elements 38 includes a pair of substantially linear racks of multiplicities of teeth 42 fixedly attached on and raised relative to the floor portion 22 of the second housing part 18. The teeth racks 42 extend parallel to one another and are spaced apart from one another and laterally outwardly from the opposite sides of the actuator 34 and the recessed channel 37 which receives the actuator 34 such that the actuator 34 is moveable in the first direction between and relative to the pair of teeth racks 42.

The second set of interengageable elements 40 includes a pair of arms 46 each rigidly attached at one end 46*a* to the floor portion 20 of the first housing part 16 and extending along one of a pair of opposite longitudinal edges 34*c* of the actuator 34. Each arm 46 has an inner portion 46*b* underlying a bottom 34*d* of the actuator 34 and extending within the channel 37 above the floor portion 20 and along the one opposite longitudinal edge 34*a* of the actuator such that the actuator 34 is movable in the first direction relative to the inner portion 46*b* of the arm 46. Also, each arm 46 has an outer portion 46*c* merging laterally outwardly from the inner portion 46*b* and extending along the adjacent one opposite longitudinal edge 34*a* of the actuator 34. The second set of interengageable elements 40 also includes the set of a plurality of teeth 44 defined on the outer portion 46*c* of each arm 46 at the other end 46*d* of the arm 46. Each set of teeth 44 points away from the arm 46 and faces toward and is adjacent to the respective portion 42*a* of one of the teeth racks 42. Each of the arms 46 is capable of being flexed in the second direction B that extends transverse to the first direction A. Also, as seen in FIG. 4A, at its other end 46*d*, each arm 46 is coupled to the actuator 34 at the second end 34*b* thereof such that in response to movement of the actuator 34 to the retracted position the arms are caused to flex inward toward the actuator 34 along the second direction B and the teeth sets 44 on the arms 46 disengage from their engaged condition with the portions 42*a* of the teeth racks 42. Conversely, in response to movement of the actuator 34 to the extended position the arms 46 are allowed to return flex away from the actuator 34 and the sets of pluralities of teeth 44 on the arms 46 move into the engaged condition with the portions 42*a* of the racks of multiplicities of teeth 42.

More particularly, as seen in FIGS. 3A and 3B, the actuator 34 at its second end 34*b* has a track 48, being substantially Y-shaped in configuration in the exemplary embodiment, defined on the bottom 34*d* of the actuator 34. First portions 48*a* of the track 48 diverge from one another along the first direction A going away the second housing part 18 and merge into a second portion 48*b* of the track 48 along the first direction A going toward the second housing part 18. The arms 46 at the other ends 46*d* thereof having respective pins 50 protruding toward the bottom 34*d* of the actuator 34 and riding within the track 48. The first and second portions 48*a*, 48*b* of the track 48 serve as cam surfaces and the pins 50 as cam followers such that in response to extension of the actuator 34 along the first direction A toward the second housing part 18 the track 48 causes the pins 50 to move away from one another into the first portions 48*a* of the track allowing return flexing of the arms to an unflexed state away from the opposite longitudinal edges 34C of the actuator 34 and engagement of the sets of teeth 44 into the portions 42*a* of the racks of teeth 42. Conversely, in response to retraction of the actuator 34 along the first direction A away the second housing part 18 the track 48 causes the pins 50 to move into the second portion 48*b* of the track 48 which forces the pins 50 to move toward one another causing flexing of the arms 46 toward each other and toward the opposite longitudinal edges 34*d* of the actuator 34 and disengagement of the sets of teeth 44 from the portions 42*a* of the racks of teeth 42.

Referring now to FIGS. 2, 5 and 6A-6B, the actuation lever 32 is pivotally mounted about a rotational axis C in upper slots 52 in a pair of upstanding wall portions 54 within an end compartment 56 of the first housing part 16 adjacent to the first end 34*a* of the actuator 34. A pair of bifurcated spring members 58 attached to the end compartment 56 and located adjacent to and outwardly of the wall portions 54 capture a pair of stub shafts 60 affixed to and extending in opposite directions from the opposite sides 32*a* of the actuation lever 32 which define the rotational axis C. The axis C extends generally parallel to the second direction B and generally transverse to the first direction A. The actuation lever 32 can undergo pivotal movement about rotation axis C defined by its stub shafts 60 between de-actuated and actuated positions, as respectively shown in FIGS. 2 and 5. The actuator 34 is moved to its retracted position in response to force imposed on it by a lower finger 32*b* on the actuation lever 32 pushing against a turned-up first end 34*a* of the actuator 34 as the actuation lever 32 is depressed by a user pivotally moving it to its actuated position, as seen in FIG. 5. The biasing force of a yieldable resilient member 62, a coil spring in the exemplary embodiment, disposed in the end compartment 56 and against the turned-up first end 34*a* of the actuator 34 causes the actuator 34 to move and return to its extended position in response to the actuation lever 34 being released by the user which allows the actuation lever 34 to return to its de-actuated position, as seen in FIG. 2. Thus, the coil spring 62 disposed adjacent to the actuation lever 32 and the actuator 34 imposes a biasing force on the actuation lever 32 sufficient to retain it in its de-actuated position and on the actuator 34 to retain it in its extended position when the actuation lever 32 is not depressed by a user. The set of teeth 44 on the arms 46 thus retain their engaged condition with the racks of teeth 42 on the second housing part 18 when the actuation lever 32 is in an un-depressed state.

The media restraint assembly 14 also includes a lock mechanism 64 mounted in the end compartment 56 and disposed adjacent the actuation lever 32. The lock mechanism 64 is adapted for undergoing movement between blocking and unblocking positions, as seen respectively in FIGS. 6A and 6B, relative to the actuation lever 32 so as to correspondingly lock and unlock and thereby restrain the actuation lever 32 from undergoing movement, and free the actuation lever 32 to be moved, from the de-actuated position to the actuated position. The lock mechanism 64 includes a support bracket 66 fixedly and stationarily mounted in the end compartment 56 of the first housing portion 16, extending across the path of movement of the actuation lever 32 between actuated and de-actuated positions. The support bracket 66, however, being arch-shaped, defines an opening 67 through it. It can be seen in FIG. 5 that a protrusion 69 on the actuation lever 32 extends through the opening 67 when the actuation lever 32 is pivoted to its actuated position.

The lock mechanism 64 also includes a lock member 68 movably mounted to the support bracket 66 for undergoing sliding movement relative thereto and generally parallel to axis C between the an unblocking position, as seen in FIG. 6A, and a blocking position, as seen in FIG. 6B, relative to the actuation lever 32. The user can manually shift the lock member 68 as desired so as to unlock it for enabling the user to then operate the actuation lever 32 or to lock it to prevent operation of the actuation lever 32. In the locked condition wherein the portion 68A of the lock member 68 extends nearly the whole way across the opening 67 the protrusion 69 on the actuation lever 32 would be unable to extend through the opening 67 and so the actuation lever 32 is blocked from actuation. A spring latch 71 on the slideable lock member 68 has a tip which is releasably mateable in two spaced apart detents on the support bracket 66 when the lock member 68 is in its respective blocking and unblocking positions. The spring latch 71 provides a tactile feedback to the user indicating that one or the other positions have been reached. There are also visible symbols on the support bracket 66 that can be observed by the user.

Referring to FIG. 7, the media restraint assembly 14 further includes a tactile feedback mechanism 70 mounted on the first housing part 16 so as to provide tactile and audible feedback to a user when one of a plurality of standard sheet length settings 72 on the housing 12 is encountered so that accurate positioning of the housing 12 at a desired one of these standard sheet length settings 72 can be attained also. A plurality of detents 74, such as in the form of "v" notches, are formed on the second housing part 18 to represent the corresponding plurality of the standard length settings 72 of sheets of media. The tactile feedback mechanism 70 mounted on the first housing part 16 and alignable with each of the detents 74 provides a user with a tactile and audible feedback when one of the detents 74 is encountered by the tactile feedback mechanism 70. The tactile feedback mechanism 70 includes a bell crank 76 pivotally mounted on a post 78 fixed on the first housing part 16 and a spring 80 mounted on the first housing part 16 so as to bias the bell crank 76 toward counterclockwise rotation to releasably engage at its pointed protrusion 82 one of the detents 74 upon encountering same so as to provide audible, tactile and or visual feedback so the user knows when one of the standard length settings 72 has been encountered.

In view of the foregoing description of the various aspects of the media restrain assembly 14 of the present invention, with reference to the figures of the attached drawings, the following benefits or advantages that derive from the media restraint assembly 14 can now be more readily understood and appreciated, which aid a user in more accurately setting the media restraint assembly 14 for best media sheet feeding and loading performance.

First, a substantially infinitely adjustable and infinitely lockable paper tray rear restraint assembly 14 is provided with increased load carrying capacity.

Second, a lock mechanism 64 is provided that can be set to lock out the actuation lever 32 from being actuated by the user to move the actuator 34 away from its extended position and thus disengage the set of teeth 44 from the rack of teeth 42.

Third, the relationships of the positions and action of the dual engagement teeth sets 44 with the teeth racks 42, along a second direction B transverse to the first direction A of the actuator, increase the load carrying capability of the restraint assembly 14. When the actuation lever 32 is un-actuated or un-depressed, the pins 50 on the arms 46 are locked in place by the track 48 on the second end 34*b* of the actuator 34. Thus, if a large load is placed on the restraint assembly 14 by aggressive use or other conditions, any forces trying to rotate the teeth set 44 out of engagement with the teeth rack 42 are instead transferred and grounded out into the actuator 34. The forces from dual engagement teeth sets 44 with the teeth racks 42 are opposed and the opposite of each other. With these features engaged and locked into place by the actuator 34 as described above, this prevents a failure mode due to a moment being placed on the teeth. It would not cause bending of the arms 46 that hold the teeth sets 44, but only through the shear of the teeth sets themselves. If the teeth can only fail in shear, the load carrying capability of the restraint assembly 14 then is significantly increased over the prior art.

Fourth, when the actuation lever 32 is depressed or actuated by the user to set the restraint assembly 14 to a new position, the cam surfaces on the track 48 that are integral with the actuator 34 function to disengage the teeth sets 44 from the teeth racks 42 due to the force inputted into the actuation lever 32 and thus into the actuator 34 by a user. Then, while still holding the actuation lever 32 depressed or actuated, the user can set the restraint assembly 14 and the floor portions 20, 22 to the new desired sheet length setting. When the actuation lever 32 is then released by the user, the force from the coil spring 62 restores the actuator 34 to its extended position and re-locks the teeth sets 44 back into engagement with the rack teeth 42.

Fifth, by locking out the user depressible actuation lever 32 using the lock mechanism, and not by use of another feature of the restraint assembly 14, it is ensured that the actuator 34 will not move and the teeth sets 44 on the arms 46 on the first housing part 16 will remain in engagement with the rack teeth 42 on the second housing part 18 and that the desired selected position of the housing parts 16, 18 remains unaffected. Sixth, the bellcrank 76 and the spring 80 integral to the restraint assembly 14 provides the user with tactile and audible feedback when a standard size setting 64 on the second housing part 18 is encountered for accurate setting of the media tray 10.

The foregoing description of several embodiments of the invention has been presented for purposes of illustration. It is not intended to be exhaustive or to limit the invention to the precise forms disclosed, and obviously many modifications and variations are possible in light of the above teaching. It is intended that the scope of the invention be defined by the claims appended hereto.

What is claimed is:

1. A media tray, comprising:

a housing having first and second housing parts interfitted with one another and slidably movable toward and away from one another along a first direction to form respective floor portions of said housing parts into a floor of said housing adapted to support a stack of sheets of media thereon of different sheet lengths; and a media restraint assembly including a position selection mechanism for placing said respective floor portions of the housing parts in a selected one position with respect to one another of a multiplicity of closely spaced apart positions corresponding to different sheet lengths, said position selection mechanism including an actuator having opposite first and second ends and being mounted on said floor portion of said first housing part for undergoing movement relative to said floor portion of said first housing part along said first direction between extended and retracted positions, said actuator including at said second end a track defined on a bottom of said actuator such that a pair of first portions of said track diverge from one another along said first direction going away from said second housing part and merge into a second portion of said track along said first direction going toward said second housing part, and a position securement arrangement on said floor portions of said first and second housing parts for undergoing conversion along a second direction transverse to said first direction between engaged and disengaged conditions in response to movement of said actuator along said first direction between said extended and retracted positions to correspondingly select and de-select said selected one position of said floor portions and accordingly set said floor portions at and release said floor portions from said selected one position, the position securement arrangement comprising a first set of interengageable elements immovably mounted on said floor portion of said second housing part, and a second set of interengageable elements mounted on said floor portion of said first housing part for undergoing movement along said second direction between said engaged and disengaged conditions with a portion of said first set of interengageable elements in response to contact with and release by said actuator as said actuator is moved between said extended and retracted positions, said second set of interengageable elements engaging with said track so as to follow said movement along said second direction between said engaged and disengaged conditions.

2. The media tray of claim 1 wherein:

said first set of interengageable elements includes at least one rack of a multiplicity of teeth; and said second set of interengageable elements includes at least one set of a plurality of teeth for engaging with a portion of said at least one rack of a multiplicity of teeth.

3. The media tray of claim 1 wherein:

said first set of interengageable elements includes a pair of substantially linear racks each having a multiplicity of teeth fixedly attached to said floor portion of said second housing part along and spaced apart from one another and laterally outwardly from opposite sides of said actuator such that said actuator is moveable in said first direction between and relative to said pair of racks of said multiplicities of teeth; and said second set of interengageable elements includes a pair of arms each rigidly attached at one end to said floor portion of said first housing part and extending along one of a pair of opposite longitudinal edges of said actuator, each of said arms having an inner portion underlying a bottom of said actuator and extending along said one opposite longitudinal edge of said actuator such that said actuator is movable in said first direction relative to said inner portion of said arm, each of said arms also having an outer portion merging laterally outwardly from said inner portion of said arm and extending along said one opposite longitudinal edge of said actuator;

said second set of interengageable elements also includes a set of a plurality of teeth defined on each of said outer portions of said arms at an other end of said arms opposite said one end thereof, each of said sets of said pluralities of teeth pointing away from said arm and facing toward and adjacent to a respective portion of one of said racks of said multiplicities of teeth, each of said arms capable of being flexed in said second direction and at said other ends thereof coupled to said actuator at said second end of said actuator such that in response to movement of said actuator to said extended position said arms flex away from said actuator and said sets of pluralities of teeth on said arms move into said engaged condition with said portions of said racks of said multiplicities of teeth, whereas in response to movement of said actuator to said retracted position said arms flex toward said actuator and said sets of pluralities of teeth on said arms disengage from said engaged condition with said portions of said racks of said multiplicities of teeth.

4. The media tray of claim 3 wherein:

said arms at said other ends thereof having respective pins protruding toward said bottom of said actuator and riding within said track with said first and second portions of said track serving as cam surfaces and said pins as cam followers such that in response to extension of said actuator along said first direction toward said second housing part said track causes said pins to move away from one another into said first portions of said track allowing flexing of said arms away from said opposite longitudinal edges of said actuator and engagement of said sets of pluralities of said teeth into said portions of said racks of said multiplicities of teeth, whereas in response to retraction of said actuator along said first direction away said second housing part said track causes said pins to move into said second portion of said track which forces said pins to move toward one another causing flexing of said arms toward said opposite longitudinal edges of said actuator and disengagement of said sets of pluralities of teeth from said portions of said racks of said multiplicities of teeth.

5. The media tray of claim 1 wherein said media restraint assembly also includes an actuation lever mounted to said first housing part adjacent to said first end of said actuator for undergoing movement between de-actuated and actuated positions, said actuator being moved to said extended position in response to said actuation lever being moved to said de-actuated position, said actuator being moved to said retracted position in response to said actuation lever being moved to said actuated position.

6. The media tray of claim 5 wherein said media restraint assembly further includes a yieldable resilient member disposed between said first end of said actuator and said first housing part for biasing said actuation lever to said de-actuated position and said actuator to said extended position.

7. The media tray of claim 6 wherein said media restraint assembly further includes a lock mechanism mounted on said first housing part adjacent to said actuation lever for undergoing movement between blocking and unblocking positions relative to said actuation lever so as to correspondingly lock and unlock and thereby restrain said actuation lever from undergoing movement and free said actuation lever to be moved from said de-actuated position to said actuated position.

8. The media tray of claim 7 wherein said lock mechanism includes a support bracket stationarily mounted on said first housing portion across said the path of movement of said actuation lever between said actuated and de-actuated positions and a lock member movably mounted to said support bracket for undergoing sliding movement relative thereto between said blocking and unblocking positions relative to said actuation lever.

9. The media tray of claim 7 wherein said media restraint assembly further includes:

a plurality of detents formed on said second housing part representing a corresponding plurality of standard length settings of sheets of media; and a tactile feedback mechanism mounted on said first housing part and alignable with each of said detents for providing a user with a tactile and audible feedback when one of said detents is encountered by said tactile feedback mechanism.

10. The media tray of claim 9 wherein said tactile feedback mechanism includes a bell crank pivotally mounted about a post fixed to said first housing part and a spring biasing said bell crank to releasably engage one of said detents upon encountering same so as to provide audible, tactile and or visual feedback so the user knows when one of said standard length settings has been encountered.

11. A media restraint assembly in a media tray, comprising:

a position selection mechanism for placing respective floor portions of a housing of a media tray in a selected one position with respect one another of a multiplicity of closely spaced apart positions corresponding to different sheet lengths of media stacked at the selected one position, said position selection mechanism including an actuator adapted for undergoing movement relative to the floor portions along a first direction between retracted and extended positions, and a position securement arrangement adapted for undergoing conversion along a second direction transverse to the first direction between engaged and disengaged conditions in response to movement of said actuator along said first direction between said extended and retracted positions to correspondingly select and de-select the selected one position of the floor portions and accordingly set the floor portions at and release the floor portions from the selected one position, said position securement arrangement including a track defined on said actuator such that a pair of first portions of said track diverge from on another along said first direction and merge into a second portion of said track along said first direction; and an actuation lever for undergoing movement between de-actuated and actuated positions, said actuator being moved to said extended position in response to said actuation lever being moved to said de-actuated position, said actuator being moved to said retracted position in response to said actuation lever being moved to said actuated position;

wherein said actuator includes a first set of interengageable elements immovably mounted on one of said floor portions and a second set of interengageable elements mounted on another of said floor portions for undergoing movement along said second direction in response to contact with said actuator as said actuator is moved between said extended and retracted positions, said second set of interengageable elements engaging with said track such that movement of second set of interengageable elements is defined by said track.

12. The media restraint assembly of claim 11 further comprising:

a yieldable resilient member disposed adjacent to said actuation lever and said actuator for biasing said actuation lever to said de-actuated position and said actuator to said extended position.

13. The media restraint assembly of claim 12 wherein said yieldable resilient member is a coiled spring.

14. The media restraint assembly of claim 11 further comprising:

a lock mechanism disposed adjacent said actuation lever for undergoing movement between blocking and unblocking positions relative to said actuation lever so as to correspondingly lock and unlock and thereby restrain said actuation lever from undergoing movement, and free said actuation lever to be moved, from said de-actuated position to said actuated position.

15. The media restraint assembly of claim 14 wherein said lock mechanism includes:

a support bracket disposed across a path of movement of said actuation lever between said actuated and de-actuated positions; and a lock member movably mounted to said support bracket for undergoing sliding movement relative thereto between said blocking and unblocking positions relative to said actuation lever.

16. The media restraint assembly of claim 15 further comprising:

a plurality of detents representing a corresponding plurality of standard length settings of sheets of media; and a tactile feedback mechanism alignable with each of said detents for providing a user with a tactile and audible feedback when one of said detents is encountered by said tactile feedback mechanism.

17. The media restraint assembly of claim 16 wherein said tactile feedback mechanism includes a bell crank and a spring biasing said bell crank to releasably engage one of said detents upon encountering same so as to provide audible, tactile and or visual feedback so the user knows when one of said standard length settings has been encountered.

18. The media restraint assembly of claim 11, wherein:

said first set of interengageable elements includes a pair of substantially linear racks each having a multiplicity of teeth fixedly attached to said floor portion of said second housing part along and spaced apart from one another and laterally outwardly from opposite sides of said actuator such that said actuator is moveable in said first direction between and relative to said pair of racks of said multiplicities of teeth; and said second set of interengageable elements includes a pair of arms each rigidly attached at one end to said floor portion of said first housing part and extending along one of a pair of opposite longitudinal edges of said actuator, each of said arms having an inner portion underlying a bottom of said actuator and extending along said one opposite longitudinal edge of said actuator such that said actuator is movable in said first direction relative to said inner portion of said arm, each of said arms also having an outer portion merging laterally outwardly from said inner portion of said arm and extending along said one opposite longitudinal edge of said actuator;

said second set of interengageable elements also includes a set of a plurality of teeth defined on each of said outer portions of said arms at an other end of said arms opposite said one end thereof, each of said sets of said pluralities of teeth pointing away from said arm and facing toward and adjacent to a respective portion of one of said racks of said multiplicities of teeth, each of said arms capable of being flexed in said second direction and at said other ends thereof coupled to said actuator at said second end of said actuator such that in response to movement of said actuator to said extended position said arms flex away from said actuator and said sets of pluralities of teeth on said arms move into said engaged condition with said portions of said racks of said multiplicities of teeth, whereas in response to movement of said actuator to said retracted position said arms flex toward said actuator and said sets of pluralities of teeth on said arms disengage from said engaged condition with said portions of said racks of said multiplicities of teeth.

19. The media restraint assembly of claim 18, wherein said arms at said other ends thereof having respective pins protruding toward said bottom of said actuator and riding within said track with said first and second portions of said track serving as cam surfaces and said pins as cam followers such that in response to extension of said actuator along said first direction toward said second housing part said track causes said pins to move away from one another into said first portions of said track allowing flexing of said arms away from said opposite longitudinal edges of said actuator and engagement of said sets of pluralities of said teeth into said portions of said racks of said multiplicities of teeth, whereas in response to retraction of said actuator along said first direction away said second housing part said track causes said pins to move into said second portion of said track which forces said pins to move toward one another causing flexing of said arms toward said opposite longitudinal edges of said actuator and disengagement of said sets of pluralities of teeth from said portions of said racks of said multiplicities of teeth.

* * * * *